US006302304B1

(12) United States Patent
Spencer

(10) Patent No.: US 6,302,304 B1
(45) Date of Patent: Oct. 16, 2001

(54) DISPENSING SYSTEMS

(75) Inventor: Jeffrey William Spencer, Kirby Muxlof (GB)

(73) Assignee: Rieke Packaging Systems Limited, Leicester (GB)

( * ) Notice: Subject to any disclaimer, the term of this patent is extended or adjusted under 35 U.S.C. 154(b) by 586 days.

(21) Appl. No.: 08/710,704

(22) Filed: Sep. 20, 1996

(30) Foreign Application Priority Data

Sep. 22, 1995 (GB) ..... 9519346

(51) Int. Cl.[7] ..... B67D 5/42

(52) U.S. Cl. ..... 222/260; 222/256; 222/321.9; 222/382

(58) Field of Search ..... 222/260, 256, 222/321.1, 321.4, 321.7, 321.9, 341, 382, 386, 387

(56) References Cited

U.S. PATENT DOCUMENTS

| | | | | |
|---|---|---|---|---|
| 1,804,582 | * | 5/1931 | Woodruff | 222/256 |
| 1,977,360 | * | 10/1934 | Talbot | 222/382 |
| 2,154,325 | * | 4/1939 | Crothers | 222/256 X |
| 2,268,592 | * | 1/1942 | Hothersall | 222/256 X |
| 2,810,496 | * | 10/1957 | Gray | 222/256 X |
| 4,728,008 | | 3/1988 | Graf et al. . | |
| 4,750,532 | | 6/1988 | Grothoff . | |
| 4,817,829 | | 4/1989 | Fuchs et al. . | |
| 5,197,637 | * | 3/1993 | Naumann | 222/260 X |

FOREIGN PATENT DOCUMENTS

| | | | | |
|---|---|---|---|---|
| 0 213 476 A2 | | 3/1987 | (EP) . | |
| 0 262 535 | | 4/1988 | (EP) . | |
| 0 499 538 A1 | | 8/1992 | (EP) . | |
| 2 510 071 | | 1/1983 | (FR) . | |
| 959835 | * | 6/1964 | (GB) | 222/260 |
| 5319466 | * | 12/1993 | (JP) | 222/260 |

OTHER PUBLICATIONS

A brochure from "Englass Dispensing & Packaging Systems", Leicester, England, Jan. 4, 1993.

* cited by examiner

*Primary Examiner*—Kenneth Bomberg
(74) *Attorney, Agent, or Firm*—Kwadjo Adusei-Poku; Lloyd D. Doigan

(57) ABSTRACT

A dispensing system has a dispenser pump mounted on top of a container. Product in the container reaches the intake of the dispenser pump through a vertical feed tube which extends down to the container's base. A follower plate fits around the feed tube and lies on top of the product and is slidable along the feed tube while sealing against the container's side wall. The foot of the feed tube interlocks mechanically with the container base, e.g. by an upward projection on the container base which fits into the feed-tube at its foot. A preferred form of the upward projection has a series of radial fins to permit the flow of product and an upwardly tapered region to facilitate installation of the feed tube. By preventing sideways movement of the feed tube the interlock arrangement improves the performance of the follower plate.

16 Claims, 2 Drawing Sheets

DISPENSING SYSTEMS

FIELD OF THE INVENTION

This disclosure relates to dispensing systems in which a pump dispenses flowable material from a container, the material being fed to the pump through a feed tube extending down into a container.

BACKGROUND

When thick or viscous products (such as gels, creams and pastes) are dispensed they do not always flow freely to the feed-tube intake. This can lead to unreliable dosing and difficulty in clearing the last part of the product from a container. It is therefore known to provide a follower plate which fits slidably around the feed tube, sealing inwardly against the feed tube and outwardly against the container side wall. The plate lies on top of the product mass to ensure that withdrawal of a volume of product through the feed tube inlet (at the container base) causes a uniform fall of the product surface. Without the follower plate, and particularly when dispensing is rapidly repeated, local voiding near the feed tube would tend to leave inaccessible product residues up the container side wall.

Even with follower plates, however, it has been found that undispensed product residues can be undesirably high and undesirably variable.

SUMMARY OF THE INVENTION

Our aim is to Provide a new dispensing system, using a follower plate and giving a more reliable reduction in non-dispensed residue.

The system generally comprises a container having a base and a side wall, to hold flowable material for dispensing, a dispenser pump mounted at the top of the container, a feed tube extending in the container down from the dispenser pump intake to the container base to convey product from the container into the pump, and a follower plate fitting axially slidably around the feed tube and extending out to the container's side wall, to follow the surface of the product down the container as dispensing proceeds.

Our proposal is that the foot of the feed tube interlocks with the container base. We have found that a significant cause of non-dispensed product is inhibition of movement of the follower plate caused by sideways movements of the feed tube in the container, e.g when a user pushes or twists the pump sideways. By providing an engagement of the tube foot with the container base to prevent such sideways movements, freedom of the follower plate is better assured and performance can be improved.

The interlock engagement may take any suitable form provided that it prevents lateral movement, since even a small deviation can hinder the follower plate. Typically this requires a fitting engagement, with laterally-directed parts of the tube fitting against laterally-directed parts of the base. The connection may however allow relative axial movement and/or rotational movement around the tube axis, particularly since these are usually needed for installing the tube in the container. An interference fit is possible but may hinder installation, so an exact fit is ideal and a slight clearance fit is usually practical. To facilitate installation, one or both of the tube foot and container base may provide tapered guide surfaces to lead the other component into fitting engagement with the fitting surfaces on installation.

The preferred version uses one or more upward projections of the container base to engage and fit inside or outside the tube foot's periphery, which is typically annular. A standard plain feed tube may then be used, only the container needing modification.

The feed tube must of course provide one or more product intake openings, and these are generally down at the container base to ensure full product clearance. The foot/base engagement construction needs to provide clearance for this. This may be achieved by a circumferentially segmented engagement, e.g circumferentially-spaced interlock segments projecting up from the container base. The narrower the segments, the less the criticality of rotational alignment between foot and base. So, a preferred construction uses a set of circumferentially-spaced, circumferentially-localised lugs or fins whose radially-directed edges make the interlock engagement.

Radially-directed fins can be provided on the base to engage either outside or inside the tube foot. AA simple and strong construction has a single central upward projection with radially-directed fins in cruciform or stellate arrangement. This projection can have a convergent top to give the guiding referred to above. The engaging parts of the base and tube foot are preferably complementarily shaped.

The components can be made by standard plastics moulding techniques.

The other components of the arrangement may be conventional.

The follower plate can be a flat plate with upwardly-flared sealing lips at its inner and outer peripheries, to seal against the feed tube and container wall respectively. However other forms of seal or follower plate may be used.

The container is typically but not exclusively cylindrical. The feed tube may be central.

The pump may be of any suitable type. One preferred form has a pump body which seats into a cap to cover the container opening. The pump chamber may extend down into the container. The feed tube may be provided by a tubular component which sits onto a spigot at the pump body inlet, or may extend up around the pump chamber as a housing for or part of the pump.

The pump is typically plunger-operated, with a fixed or movable dispensing nozzle mounted above the container, but this is just one preferred option. Indeed, a pump could be separately mounted provided that its feed from the container top originates with the feed tube.

Aspects put forward for protection here include not only the dispensing system as a whole but also the combination of container and feed tube (with or without the follower plate) adapted to engage one another as aforesaid, and also a container whose base is provided with one or more upstanding engagement projections as described herein.

DETAILED DESCRIPTION OF THE PREFERRED EMBODIMENTS

Figure 1:
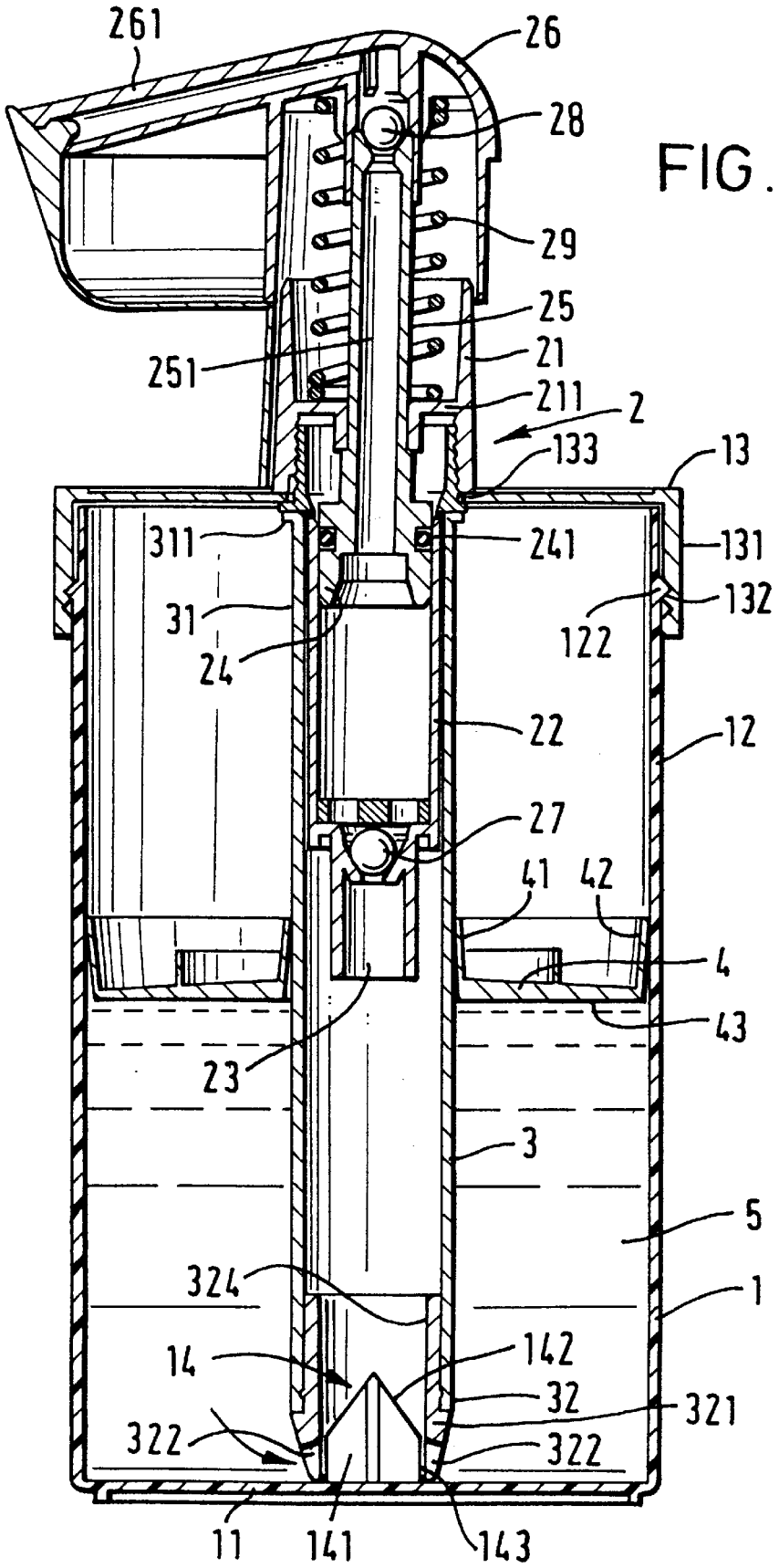
FIG. 1 is an axial cross-section through a dispensing system.

Referring to FIG. 1, a cylindrical container 1 has a cylindrical side wall 12 and a flat base 11. The container is a one-piece plastics moulding e.g of polypropylene. A pump 2 is mounted over the top opening of the container 1, by means of a cover cap 13. The cap 13 snap fits onto the container 1 by means of a downward skirt 131 having an annular recess 132 which snaps onto a annular bead 122 on the outside of the container wall 12. The body of the pump 2 Is mounted through a hole 133 in the centre of the cap 13 by a screw or snap fit between a lower body sleeve or cylinder 22, which extends generally below the cap 13 but has a screw or snap collar projecting up through the hole 133, and an upper body sleeve 21 which screws or snaps down around that collar to trap the cap and hold the body in position. The lower body sleeve 22 defines a cylindrical pump chamber in which a piston 24 is vertically reciprocable together with a piston rod 25 and a plunger head 26 fixed to the top of the piston rod 25. In this embodiment the piston is hollow, communicating with a discharge channel 251 extending up through the piston rod 25 to an outlet valve 28 in the head and thence to a transverse discharge spout 261 which moves up and down with the head. The upper body sleeve 21 has an inward shelf 211 with a central hole through which the piston rod 25 slides; the shelf 211 provides both an upper limit for the travel of the piston 24 and a lower abutment for a pump spring 29 which tends to urge the head 26 to its upper position.

The bottom of the lower body sleeve has an axial intake spigot 23 leading to the pump chamber through an inlet valve 27.

Such a pump is conventional, and other types of pump may be used. The pump body may be of polypropylene.

A parallel-sided (in this embodiment, cylindrical stiff feed tube 3 extends from the top to the bottom of the container 1, in line with the pump at its centre. The foot 32 of the tube 3 lies on the pump base 11; from here the tube 3 extends up and around the pump intake 23, around the lower pump body sleeve 22 (with a close fit) and has a top flange 311 abutting against a shoulder of the pump body adjacent the top cap 13. The top of the feed tube 3 is thus fixed firmly in position.

Figure 3A:
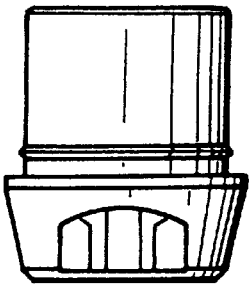
Figure 3B:
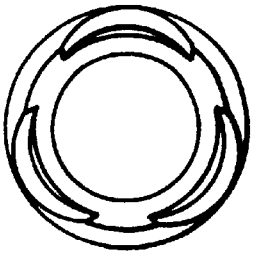

The foot of the feed tube 3 provides circumferentially-spaced openings 322 for the inflow of product 5 from the container. Between the openings 322 portions of the tube foot reach down to support the tube against the container base 11. In this embodiment, three circumferentially-spaced openings 322 are provided. For ease of moulding, the foot of the tube with the openings is provided as a separate insert component 321 which defines the openings 322 and also has an upper tubular part 324 which plugs into the foot of the main cylindrical feed tube body 3. This is shown more clearly in FIGS. 3(*a*) and (*b*), which show the insert component separately. If desired and appropriate, the opening may be formed directly in the foot of a single tube component. The feed tube may be moulded, e.g from polypropylene or high-density polyethylene (HDPE).

A follower plate 4 is provided to rest on top of the body of product 5 in the container and follow it down the container as dispensing progresses. The follower plate comprises a generally flat radial web 43 with an inward annular sealing lip 41 sealing against the feed tube wall and an outer annular sealing lip 42 sealing against the container wall. In the present embodiment the sealing lips 41,42 are provided at upwardly-flaring tapered portions formed in one piece with the remainder of the follower plate 4. Upwardly-extending seals are desirable so that the main web 43 of the follower plate 4 can reach down to the base 11 of the container. The follower plate may be of LDPE.

Figure 2:
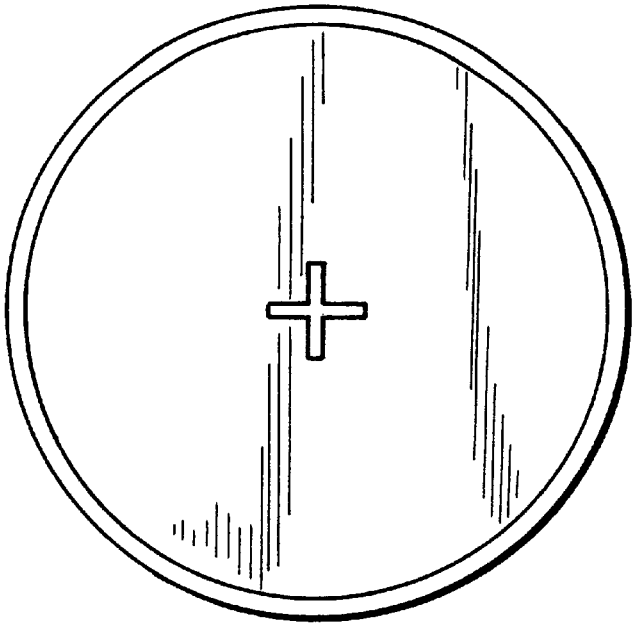
FIG. 2 is a plan view onto the base of the container in the FIG. 1 system, and FIG. 3(*a*) and 3(*b*) are side and bottom views of a feed tube foot insert.

A locating projection 14 extends up from the container base 11 through the open foot of the feed tube 3. This projection 14 can be moulded in one piece with the container. It extends up into the tube past the openings 322. In shape, as also seen from FIG. 2, it consists of a set of radially-projecting axial fins 141, each with an edge whose radially outermost part is an axially-straight fitting portion 143, with above that a tapered guide region 142 slanting in towards the tube axis. In this embodiment the fins 141 meet in the middle and there are four of them, so they form a cruciform spike projecting up from the container base. Their convergent upper regions 142 form a guide-so that when the system is being assembled and the feed tube put into the container, it is easy to push its foot onto and into fitting relationship with the projection 14. The inward surface of the tube foot (here, of the insert 321) conforms closely (say within 0.5 mm) to the outer dimension of the fitting region 143 of the spike, thereby preventing any significant lateral movement of the tube's foot 32.

In operation, we find that the provision of a fitting projection such as the cruciform spike 14 significantly improves the performance of the follower plate. In tests done with an otherwise identical pump lacking the cruciform spike 14 the non-dispensed residue of product was usually less than 8%, but there were a few occasions in which it exceeded 8%. Conversely, in tests carried out with the pump arrangement shown in FIG. 1 we achieved less than 5% residue with complete reliability.

The skilled reader will appreciate that the cruciform spike shown is merely one convenient way of is achieving the desired effect. It has the advantage of simplicity and strength. The use of fins minimises the obstruction to the openings 322, so that no particular rotational alignment is needed between the tube 3 and protection 14. At the same time the combination of the fins into a single stellate projection gives it greater strength.

Nevertheless, the same effect could be achieved using discrete fins or lugs projecting from the container floor, and these might engage the outside as well as or instead of the inside of the tube foot.

Another possibility is to recess the container floor to receive the tube foot, but this may be more difficult to achieve with thin container walls unless some additional guide projection is provided.

What is claimed is:

1. A dispensing system comprising:

a container, said container having a side wall and a closed continuous base formed in one piece with the side wall and being adapted to hold a flowable material for dispensing;

a dispenser pump mounted at a top of the container to dispense said flowable material, the dispenser pump having an intake to receive said flowable material from the container;

a feed tube extending in the container down from the dispenser pump intake to the container base, to convey said flowable material from the container into the dispenser pump intake, the feed tube having a foot adjacent the container base;

a follower plate fitting axially slidably around the feed tube and extending out to the container side wall, to follow a surface of the flowable material down the container as dispensing thereof proceeds; and the feed tube foot and the container base comprising respective interlock portions presenting respective laterally-directed surfaces which overlap axially in a close-fitting interlock engagement to inhibit sideways movement of the feed tube in the container.

2. A dispensing system as claimed in claim 1 in which the container base interlock portion comprises one or more upward projections and the feed tube interlock portion is provided by an annular periphery of the feed tube foot which fits against said one or more upward projections of the container base.

3. A dispensing system as claimed in claim 2 in which said one or more upward projections engage an inside of said annular periphery of the feed tube foot.

4. A dispensing system as claimed in claim 2 in which said one or more upward projections comprise a plurality of upstanding fins, directed radially relative to the feed tube.

5. A dispensing system as claimed in claim 2 in which said one or more upward projections from the container base comprises plural radially outwardly-directed fins in a cruciform arrangement.

6. A dispensing system as claimed in claim 2 in which said one or more upward projections from the container base comprises plural radially outwardly-directed fins in a stellate arrangement.

7. A dispensing system as claimed in claim 1 in which at least one of the container base interlock portion and the feed tube interlock portion has a tapered guide surface to facilitate interlocking of the feed tube and container base during assembly.

8. A dispensing system as claimed in claim 2 in which the container base and the one or more upward projections at its interlock portion are a one-piece moulded entity of plastics material.

9. A dispensing system comprising:

a moulded plastics container, said moulded plastics container having a closed continuous base and a sidewall moulded integrally with the base, and being adapted to hold flowable material for dispensing;

a dispenser pump mounted at a top of the moulded plastics container to dispense said flowable material; the dispenser pump having an intake to receive said flowable material from the moulded plastics container;

a feed tube extending in the moulded plastics container from the dispenser pump intake down to the moulded plastics container base, to convey said flowable material from the moulded plastics container into the dispenser pump intake, the feed tube having a foot with a downwardly-opening annular periphery adjacent the moulded plastics container base;

a follower plate fitting axially slidably around the feed tube and extending out to the moulded plastics container side wall, to follow a surface of the flowable material down the moulded plastics container as dispensing proceeds; and the container base having an interlock portion comprising a plurality of interlock segments projecting up from the container base, said interlock segments fitting against the annular periphery of the feed tube foot at circumferentially-spaced engagement locations to inhibit sideways movement of the feed tube in the container while permitting said flowable material to flow into the feed tube between said segments.

10. A dispensing system as claimed in claim 9 in which the interlock segments are fins having radially-directed edges which engage the feed tube foot.

11. A dispensing system as claimed in claim 10 in which the radially-directed edges of the fins engage inside the feed tube foot.

12. A dispensing system as claimed in claim 10 in which the fins intersect one another in a stellate arrangement.

13. A dispensing system as claimed in claim 10 in which the fins have upper portions with guide edges, inclined to a axial direction, to guide the feed tube foot onto the radially-directed edges during assembly of the system.

14. A dispensing system comprising:

a cylindrical container, said container having a closed, continuous flat base, a side wall and a top cover cap and being adapted to hold a flowable material for dispensing;

a dispenser pump mounted at a top of the container through said top cover cap to dispense said flowable material; the dispenser pump having an intake to receive saidflowable material from the container;

a feed tube extending in the container from the dispenser pump intake down to the container base, to convey said flowable material from the container into the dispenser pump intake, the feed tube having a foot adjacent the container base;

a follower plate fitting axially slidably around the feed tube and extending out to the container side wall, to follow the surface of the flowable material down the container as dispensing thereof proceeds; and the container base comprising a single central upward projection having radially-outwardly-directed fins intersecting in a stellate arrangement, the fins having lower axially-extending edge portions which are radially-directed and engage with a close fit in the foot of the feed tube to inhibit sideways movement thereof in the container, and upper mutually convergent edge portions providing a guide to facilitate fitting of the feed tube foot onto the upward projection.

15. A dispensing system as claim in claim 14 in which the upward projection is formed integrally with the container base by moulding.

16. A dispensing system as claimed in claim 14 in which the feed tube foot has circumferentially-spaced openings separated by foot portions reaching down to abut the container base.

* * * * *